United States Patent [19]

St. Clair

[11] 4,055,960

[45] Nov. 1, 1977

[54] STIRLING CYCLE ENGINE

[76] Inventor: John Craig St. Clair, P.O. Box 3345, University Station, Columbus, Ohio 43210

[21] Appl. No.: 702,417

[22] Filed: July 6, 1976

[51] Int. Cl.[2] ..... F25B 9/00

[52] U.S. Cl. ..... 62/6

[58] Field of Search ..... 60/517, 518, 519, 520; 62/6

[56] References Cited

U.S. PATENT DOCUMENTS

| | | | |
|---|---|---|---|
| 3,364,675 | 1/1968 | Dorer | 62/6 |
| 3,416,308 | 12/1968 | Livezey | 62/6 |
| 3,481,142 | 12/1969 | Schulze | 62/6 |

*Primary Examiner*—Lloyd L. King

[57] ABSTRACT

The hot and cold gases of a Stirling Cycle engine are stored in the opposite ends of a rotating hollow cylinder with the inner surface of the cylinder covered with water held in place by centrifugal force. The hot and cold gases are kept separate by a piston, that moves back and forth in the rotating cylinder, with the outer edge of the piston dipping in the ring of water providing a gas seal.

The gas when heated and introduced into the hot end of the rotating cylinder is given the same angular velocity as the rotating hollow cylinder by means of a large number of small holes in a molybdenum sheet of metal. The molybdenum metal is strong and is not corroded, in the hydrogen gas used as the working fluid, at temperatures as hot as 2200° Fahrenheit or even hotter.

The system is the basis of a low first cost power plant where hydrogen is compressed, expanded through a turbine with the generation of power and then compressed over again. The overall power plant needs less than 7500 BTU per KWH. With the use of Solar heat stored in enormous piles of sand-lime pebbles with cooling water sprayed in winter and stored in holes, from which has been obtained sand which is made into sand-lime mortar for the pebbles, heat rates of as low as 6500 BTU per KWH can be obtained.

11 Claims, 2 Drawing Figures

STIRLING CYCLE ENGINE

In a Stirling Cycle engine hot gas and cold gas are separately stored in a hollow cylinder with the hot and cold gases separated by a easily movable piston across which is maintained a negligible pressure differential. By removing cold gas and heating it and inserting it with the hot gas the pressure of the gas in the cylinder rises, the piston moves and part of the cold gas may be removed as compressed gas product.

The Stirling Cycle in one respect is a much more efficient way than usually used to convert heat into power by the process of compressing a gas while it is cold and expanding the gas, you compressed, while it is hot and taking the difference between the power of compression and the power of expansion as net power. This is so because as normally and widely carried out for other processes, as for example in a gas turbine (which uses the Brayton Cycle), there are inefficiencies of usually of the order of 85% in each compression and expansion of the gas. And to get efficiencies as high as these, compression ratios of at least 4 are required which means the gas is compressed in its final stages of compression at temperatures much higher than desirable with a large addition to the power required for compression. As a result the gas turbines with their Brayton Cycle now widely used, use roughly twice the amount of power that is theoretically required to compress the gas that is later heated and expanded with the generation of power. On the other hand the Stirling Cycle obtains practically a 100% efficient compression with a very low compression ratio so that the gas is compressed at very low temperatures and uses power for this compression that is obtained with practically 100% efficiency from the heat supplied to the system. In other words the Stirling Cycle saves nearly 50% of the heat normally needed to compress the gas.

Also the Stirling Cycle has the advantage that normally cold compressed gas is removed from the system and expanded for the generation of power. This can be done since in the cycle the expansion of the hot gas can be used to compress, with nearly 100% efficiency, cold gas. As a result when the Stirling Cycle is used to generate power the problems of expanding very hot gases can easily be avoided.

However the Stirling Cycle has enormous problems that have never been previously solved though inventors have tried for 150 years to do so. (See U.S. Department of Commerce, NTIS report ISBN-O-85494-327-7, Stirling Cycle Engine Development, A Review, July 1975.)

One enormous problem of the Stirling Cycle is the enormous heat losses from the hot gas, while it is stored, to the walls of the storage vessel storing it. This heat loss is very serious since for a few seconds or less the vessel will first store hot gas and then for a few seconds or less store cold gas, which cycle is constantly repeated. Then the walls must have a seal so the piston can move back and forth separating the hot and cold gases. This means the walls must be cold. And with the complication of there only being a small amount of power generated per weight of hot gas being cycled the heat losses per amount of power have always been high in the past even with very expensively designed equipment.

A second problem is that, with the low compression ratio, only a small amount of power is generated from a pound of gas that must be heated to very high temperatures with, hopefully, the heat recovered when the pound of gas is then cooled. The result of this is that unless helium, or preferably hydrogen, is used at high pressures as the working gas in the Stirling Cycle, this heat exchange becomes impractical unless one is willing to accept large heat losses for this operation. But if one uses high pressure hydrogen or helium you cannot supply heat to the cycle by burning fuel in your working gas like fuel oil, etc., is burnt in the air used as the working medium for the competitive and widely used gas turbine cycle. And if you try to supply this needed heat by first heating a bed of pebbles by combustion gases and then heating the high pressure hydrogen or helium by passing the hydrogen or helium through the hot pebbles your run into another very serious limitation of the Stirling Cycle. This limitation is that the theoretically possible amount of product that can be taken off with each movement of the piston back and forth or cycle is determined by the amount of hot storage provided. And from this theoretically possible amount of product must be subtracted the amount of gas necessary to raise the pressure from the minimum pressure in the cycle to maximum pressure in the cycle in the volume of the apparatus other than the hot gas storage. So everytime you add more equipment without increasing the volume of hot gas storage you decrease the amount of product gas per cycle without decreasing the total heat losses. Since prior designs must keep the volume of hot gas storage to the barest minimum to reduce heat losses in the hot gas storage, the addition of the extra volume required for a regenerative heating of high pressure helium or hydrogen to provide the needed outside heat input is completely impractical.

So it can be seen from the above that if it is possible to provide a practical method for supplying for a Stirling Cycle engine, at reasonable cost, a hot gas storage system with very low heat losses it will produce a fantastic improvement in the Stirling Cycle engine. This the applicant proposes to do by rotating the hollow cylinder in which the hot and cold gases are stored, maintaining a layer of water over the inner surface of the rotating hollow cylinder by centrifugal force with the water providing the necessary seal between the edge of the piston that moves back and forth, and the rotating cylinder, and preferably creating a low type of turbulent gas flow in the cylinder by inserting the hot gas into the cylinder spread over the cross section of the cylinder and at substantially the same angular velocity around the same axis as the revolving cylinder. By the combination of water rotating outside gases of molecular weight less than water, the trace of evaporation of water will create gas density differences that under centrifugal force will stop turbulence and greatly reduce heat transfer from the hot gas to the cold outer wall covered with water.

Figure 1:
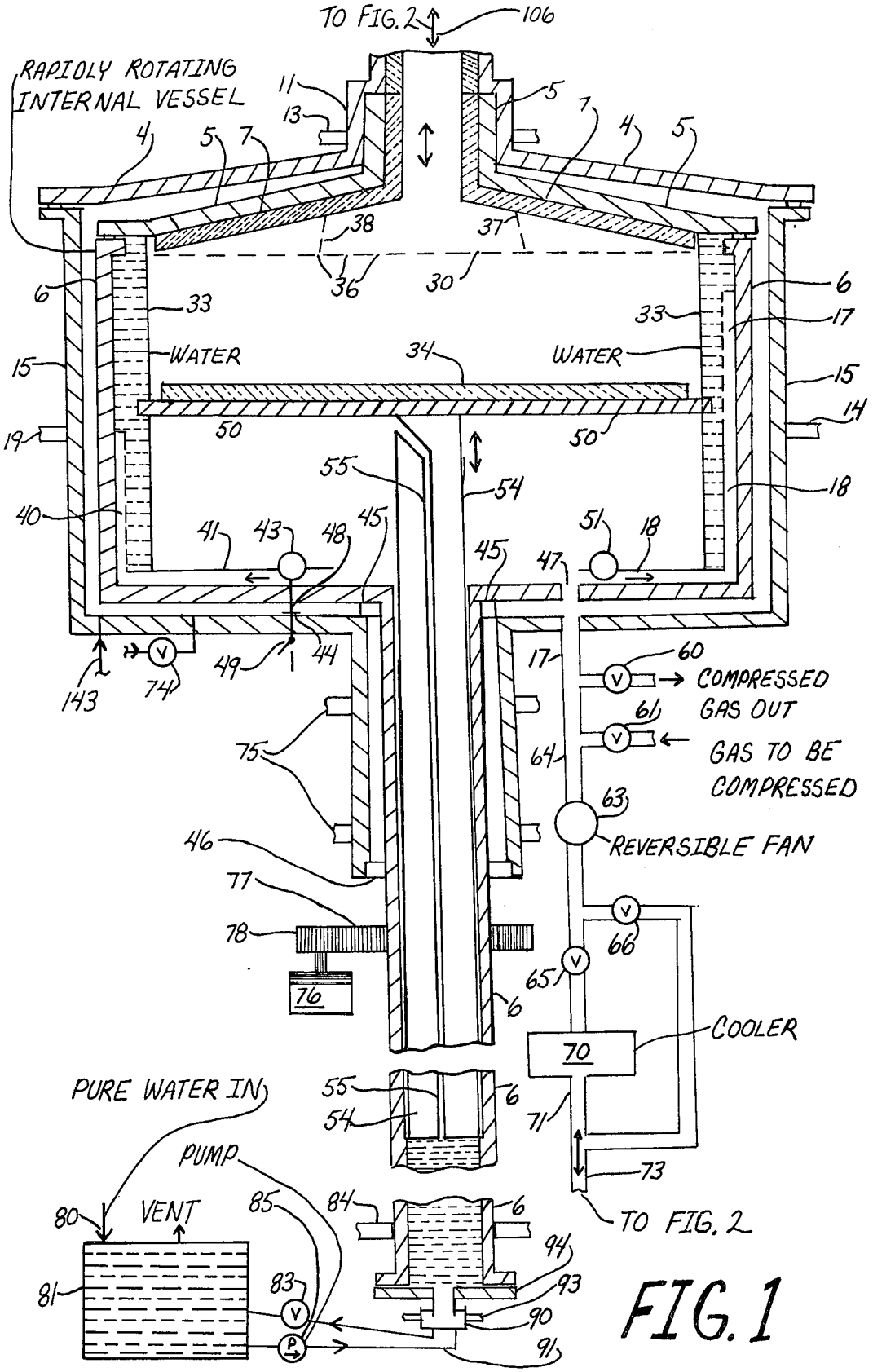
FIG. 1 shows the rotating hot and cold gas storage system of the proposed Stirling Cycle Engine.

Referring to FIG. 1 of the drawings we see at 15 a stationary cylindrical vessel mounted on stationary beams 19, 14 and 75. Inside stationary vessel 15 is cylindrical rotating vessel 6 which rotates on bearings 11, 45 and 46. Bearing 46 also provides the duty of a stuffing box keeping the gases at high internal pressure in vessel 15 from leaking to the atmosphere. Internal rotating vessel 6 has holes like 47 in its bottom wall so gases inside the lower section of internal rotating vessel 6 easily pass back and forth through its lower wall and out and in through the bottom wall of outside stationary vessel 15 by pipe line 17. On the top of outside stationary vessel 15 is bolted on (by bolts not shown) a removable top cover 4 on the center of which is mounted the bearing 11, previously mentioned, which is steadied by beam 13. On the top of internal rotating vessel 6 is a removable cover 5 bolted on (by bolts not shown) which has its center upward extension rotate in bearing 11 previously mentioned.

Insulating underneath the removable top cover 5 is insulation 7. Insulation 7 is of similar construction as insulation 34 on the top of the piston 50 dividing the rotating cylindrical vessel 6. Preferably it is made of fiber type insulation, like Kaowool ceramic fiber insulation, which is the trademark of Babcock & Wilcox Co., which is held in place both by the usual method of impaling on studs welded to the cool metal surface it insulates and by having a thin layer of molybdenum sheet metal covering it.

In the top of internal rotating vessel 6 is a sheet 30 of metal, usually molybdenum metal, in which small holes 36 have been drilled to spread the flow of the gases evenly down over the cross section of the internal rotating vessel 6 when the piston which has an upper face 34 is lowered in the rotating internal vessel 6. The best distribution is preformed by having holes as small as can be conveniently drilled in the sheet of metal 30 but usually holes of about one-eigth inches in diameter are preferred. Also if the metal is of the type like molybdenum which under the contacting gas atmosphere (which is preferably hydrogen containing) has a surface like a mirror and has a very low emissivity (molybdenum metal has an emissivity of radiant heat of about 0.16 of a black body) the total area of holes should be kept as low as possible to keep the radiation through the holes as low as possible. So an area of holes of around 5% of the total area is preferred, or one ⅛ inch diameter hole every 0.56 inch by 0.56 inch square of sheet metal 30. The sheet of metal 30 is supported by strips 37 and 38 to the outer metal protecting wall of insulation 7.

Inside internal rotating vessel 6 piston 50 moves up and down. Piston 50 is mounted on plunger 54 which moves up and down in the lower extension of internal rotating vessel 6. Distilled water (or its equivalent by ion exchange or water obtained as condensate from cooler 70 later described) enters the system by pipe line 80 and is stored in water tank 81. Water from tank 81 is pumped by pump 85 through pipe line 91 and rotary seal 90 into the flange 94 into the bottom of the lower extension of internal rotating vessel 6. The water passes up the tube 55 in the plunger 54 and passes out under centrifugal force, from the rotation of the apparatus (the piston 50 rotates with the vessel 6 it is in due to friction of its extensive common walls with vessel 6). The internal rotating vessel 6 is rotating by motor 76 driving cogged wheel 78 meshing in cogs 77 mounted on the lower extension of internal rotating vessel 6. The water passing out by centrifugal force from the upper end of tube 55 lands at 33 on the inner surface of the internal rotating vessel 6.

The edge of piston 50 is submerged in the water layer 33 and this effectively forms a seal between the hot upper gas filled part of the internal rotating vessel 6 and the cool lower gas filled part of the same vessel 6. Under actual operation, when temperatures of the gas the top part of the vessel are over 2000° Fahrenheit, radiation from the hot parts of the apparatus will cause evaporation of water. At such temperatures it will be normally necessary to use molybdenum sheet metal (or possibly tungsten sheet metal) and this can be corroded by steam at higher temperatures. Therefore hydrogen is pumped under the surface of the water to maintain a reducing atmosphere at all times at temperatures where the steam will react with the molybdenum sheet metal. This is done by passing hydrogen at a desired rate under the surface by spargers 40 and 17, which are only two of a group of similar spargers around the circumference of the vessel 6. The flow of hydrogen under the surface of the water is not necessary when the piston maintains cool gases above the water surface so by having spargers at different locations say hydrogen can be pumped by fan 51 through pipe line 18 to sparger 17 and as needed hydrogen can be pumped by fan 43 through pipe line 41 to sparger 40. The fan 43 is controlled by turning on and off by switch 49 the electric current supplied by electric current carrying wire 48 which seats as it rubs as it travels over contact ring 44. The method of supplying electricity to fan 51 is identical to that of fan 43 and therefore does not need to be shown in the drawing.

The percentage of hydrogen needed in steam to keep it from reacting at various temperatures has been accurately determined by others and can be found in the book "Molybdenum Compounds" by Killeffer and Linz, Interscience Publishers, New York, 1952, page 23. It will be immediately noticed that at higher temperatures like above 1700° Fahrenheit which about all the molybdenum will be at all the time there will be absolutely no problem with corrosion by steam. The concentration of steam will be way below the 50% of the total pressure, required for corrosion. Obviously the small areas that could theoretically corrode could be made extra thick and periodically replaced. However the book "Corrosion Handbook" by Uhlig, John Wiley, New York, 1948, page 253, says cold wet hydrogen, besides hot wet hydrogen, does not corrode molybdenum. Obviously this is due to the slowness of the reaction of the cold wet hydrogen. Therefore keeping the hydrogen content of the evaporating steam off water 33 as much as 75% by volume of the hydrogen-steam mixture will very obviously prevent corrosion of the molybdenum by the steam being a drawback of any magnitude for the equipment shown.

The force to move piston 50 up and down is supplied by two sources. The source already mentioned is the water pumped from tank 81 by pump 85 through pipe line 91 into the bottom of revolving internal vessel 6. The cylinder 54 shown can be provided so it will float though this is not necessary. Just keeping the leakage around the cylinder 54 to a minimum is frequently preferred. An advantage of this is to get for piston 50 very fast decelleration at the end of the stroke which is followed by very fast acceleration in the other direction just before and then at the start of the of the down stroke of piston 50. This is done by opening valve 83 and letting the internal pressure in the apparatus blow some water out of the bottom of vessel 6 all of a sudden. This is normally preferred since at the end of the stroke the cooler gases that have been near the water 33 all of a sudden are contacting the hotter sheet metal piece 30. If the reversal of the piston 50 is done in a small fraction of a section this cooler gas will not have time to cool and put thermal contraction stresses on metal piece 30 and also the metal protector for insulation 7.

Figure 2:
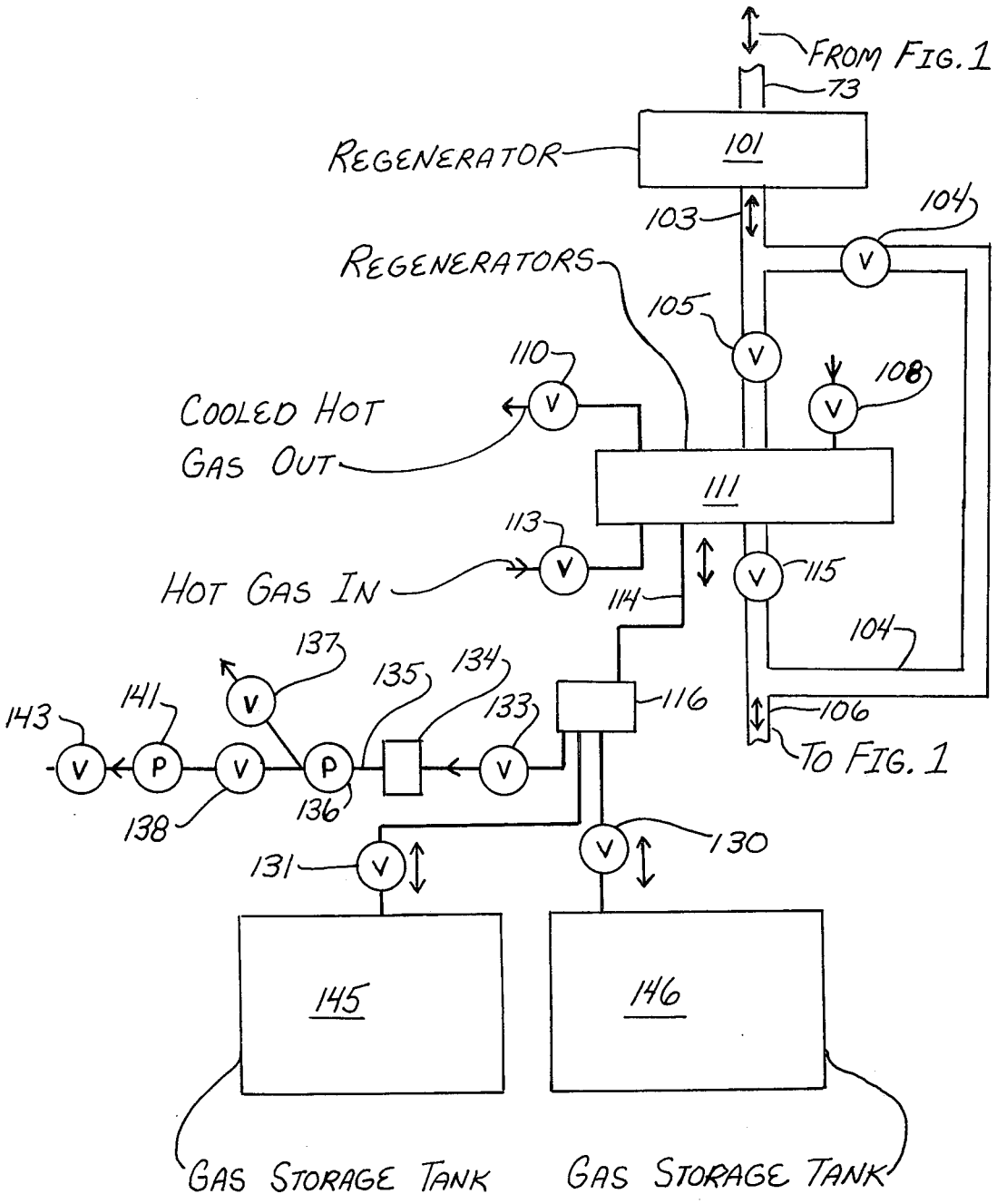
FIG. 2 shows the accessory equipment needed by FIG. 1. In the figures hydrogen is compressed.

The other source of power to move piston 50 is reversible fan 63 as it sucks gas from inside the lower part of revolving cylinder 6 through hole 47 and pipe line 64 to the fan 63 and then forces the gas through valved pipe line 66 to pipe line 73 to regenerator 101 in FIG. 2. Regenerator 101 is of conventional construction in which the regenerator is filled preferably with wire screens, though if desired special ceramic forms may be used or even pebbles.

Then the gas which usually has been heated to over 1000° Fahrenheit passes by pipe line 103 where it is split and part passes by valved pipe line 104 to pipe line 106 and the rest passes by valved pipe line 105 to regenerators 111 where the gas is usually heated to as hot as 1800° Fahrenheit, and frequently as hot as 2200° Fahrenheit. Regenerators 111 represent either one regenerator or much more frequently a group of regenerators with one being used to heat the gas while the rest of the regenerators are being heated by some source of hot gas. These regenerators normally would be filled with pebbles of about a half inch in diameter. Valves to each regenerator must be of types that can stand very high temperatures and while they may be of the type used by government bureaus in their research on the energy problem as applied to magnetohydrodynamics I prefer to use my own valves as described in U.S. Pat. No. 3,478,772, patented Nov. 18, 1969. These latter valves have the lip of an inverted cup like valve plug seating into a circular trough containing water over a rubber valve seat in the bottom of the trough. In the regenerator set up 11 the regenerator, as is conventionally done, will have its pebbles heated for a period and then by closing and opening valves the gases to be heated will be heated for a period.

However the big and in fact the only thing the above regenerator assembly 111 will have that is not very old in the art is the way the gas being heated and the gas used for heating will be kept in their proper places and intermixing will be practically eliminated.

When regenerator 111 is heated by hot gases, initially it will contain valuable gases, such as hydrogen, under pressure and special precautions must be taken to prevent the loss of these gases. After closing valves 105 and 115 the pressure is first partially reduced in a first step by opening valve 130.

The pressure will be partially reduced in regenerator 111 since gas will then flow through pipe line 114 to small regenerator 116 which cools the gas and the gas will be stored in gas storage tank 146. Then valve 130 is closed and valve 131 is opened and more of the gas under pressure in regenerator 111 flows by pipe line 114, is cooled in regenerator 116 and passes into gas storage tank 145. Then valve 131 is closed and valve 133 is opened and the regenerator 111 is put under vacuum of an order of 0.1 atmosphere absolute pressure by operation of vacuum pump 135 which draws off gas under vacuum passing from regenerator 111 by pipe line 114, cooled by regenerator 116 and cooled finally by water cooled cooler 134, and passing to vacuum pump 136 by pipe line 135. This gas passes from vacuum pump 136 by valved pipe line 138 to compressor 141 which passes it back into the system by valved pipe line 143 to stationary vessel 15. At the end of the application of vacuum to regenerator 111 steam is added to regenerator 111 by valved pipe line 106. This sweeps all but the slightest traces of the gases initially in regenerator 111 out of regenerator 111. The added steam is condensed by cooler 134 before the swept out gas is compressed again by vacuum pump 136.

The heating gases for regenerator 111 are provided by valved pipe line 113 are then turned on by opening valve 113 and valve 110. These hot gases are preferably hot air heated by contacting hot pebbles made of old fashioned sand-lime mortar made by reacting quartz sand with a few percent of lime plus some water and allowing the mixture to set and then breaking up with enormous teeth pulled by a tractor. These pebbles may be heated at low cost by focusing sunlight on targets with air being heated by sucking the air heated through piles of the pebbles. Such a method for heating hot gases, such as air, is described in my patent application Ser. No. 542,384 entitled USE OF SOLAR ENERGY HEAT GATHERING SYSTEMS TO INCREASE FARM CROP YIELDS for which all claims have been granted as U.S. 3,981,151. The increase in yields of crops such as corn will pay for much of the cost of the mirror. If one uses my more recent patent application Ser. No. 692,321, entitled THOUSAND FOOT DIAMETER FOCUSING SOLAR MIRROR, with many cases the extra crops will pay for the cost of the mirrors.

However gases heated by conventional fuels may be used, though if coal is used, it is preferably coal having ashes with a fusion point of at least 2200° Fahrenheit. (It is to be emphasized that the fusion point of the ashes in coal may be greatly raised by removing most if not all the pyritees by conventional methods. This will also greatly reduce the sulfur content and the resulting air pollution.)

After the pebbles in regenerator 111 are reheated, the residual hot air in the regenerator is first sucked out by the vacuum pump 136 through in succession pipe line 114, regenerator 116, valved pipe line 133, cooler 134 to the vacuum pump 136 and then out through valved pipe line 137. Then steam is passed through by 106 and finally 133 is closed.

Then the regenerator 111 is first partly pressurized by opening valve 131 which allows the gas under pressure in gas storage tank 145 to flow through regenerator 116 which heats it and then through pipe line 114 into regenerator 111. Then valve 131 is closed and valve 130 is opened allowing gas to flow from gas storage 146 through regenerator 116 which heats the gas and then through pipe line 114 into regenerator 111. Then valve 130 is closed.

Then valves 105 and 115 are opened and heated gas normally at about 1800° Fahrenheit or more flows from regenerator 111 through valved pipe line 115 and then pipe 106 to enter through hollow bearing 11 and shaft 5 into revolving cylinder 6. It is important in smaller uses of the invention that the hot gas be given the same angular velocity as revolving cylinder 6. In this way there will be greatly reduced the amount of turbulence produced by the gas rotating at an angular velocity different from the angular velocity of the rotating cylinder 6. Of course for very large uses of the invention profitable operation of the invention may be still obtained with very large variation of the two angular velocities, especially if the gas at the wrong angular velocity is in the center line of the revolving cylinder 6. But it is just so easy to do this properly and avoid unnecessary heat transfer, caused by turbulence of the hot gas, to the water 33. It is emphasized that this is an extra benefit of the present water seal method disclosed.

The preceding flow of gas is carried out when the piston 50 is lowered. The cold gas pushed out by piston 50 and is heated as previously described and as mentioned passes into the top of the rotating internal vessel 6 and is distributed evenly over the cross section of the vessel 6 it enters by metal sheet 30 which has small holes 36 evenly distributed over it.

This preceding flow of hot gas causes the pressure to rise in internal rotating vessel 6 and stationary vessel 15 and when the pressure rises to the desired pressure valve 60 is opened and compressed gas is bled off by valve 60 for use as desired while the piston 50 is lowered to the bottom of the stroke.

When the piston 50 is lowered as far as it can go the piston is then raised. This causes the flow of gas through pipe line 106, pipe line 104 (valve 104 being open), pipe line 103, regenerator 101, pipe line 73 with the reverse in flow being away from the hot end above piston 50 of the internal rotating vessel 6 and towards the cold end below piston 50. However normally the same path backwards is not usually taken in its entirity. We now close valve 66 and open valve 65 and pass the gas through pipe line 71 and cooler 70 where the gas is cooled conventionally by contacting the gas either directly with cold water or by cooling indirectly with water cooled metal tubes. Cooling by direct contact the gases with water is very convenient in this present case since there are already vacuum facilities for sucking of absorbed air from the water and facilities for recovering gases dissolved under pressure in the water after it is used. These were described with the description of keeping the air and the gas heated separate with little losses for regenerator 111.

Then the cooled gases pass by valved pipe line 65 to reversible fan 63 which blows the gases through pipe lines 64 and 17 into the bottom of internal rotating vessel 6 through hole 47. This reduces the pressure of rotating internal vessel 6 back to its original pressure and, when that happens, gas to be compressed, is allowed to enter by opening valve 61. After piston 50 is raised as high as it will go valve 61 is closed and the procedure of lowering the piston as previously described is repeated.

If we expand the compressed gas in a turbine with the generation of power and insert the expanded gas back into the system as the gas we compress we have a very efficient method for converting heat into power. The use of hydrogen and to a lesser extent helium results in a very high conversion of heat into power with low cost equipment producing power from less than 70% of the heat required by more costly presently widely used gas turbines.

In the above procedure we have obtained a system requiring considerably less heat to produce the same amount of work by cutting down the usual heat losses in the section of a Stirling Cycle engine where the hot gas is stored. It requires the use of a gas with a lower molecular weight than water to be used as the working gas since when the water evaporates from heat radiated by high temperatures the water vapor, or more exactly the water light gas mixtures, will stay because of centrifugal force acting on the heavier water vapor next to the layer of water and not cause mixing of the colder gases at the outer edge of the rotating storage cylinder 6 with the hot gases closer to the axis of the cylinder 6. Therefore the problem of heat transfer from the cold outer wall to the hot inner gases is only a problem of a slow rate of heat transfer of heat through the gases. Of course this reduction to such a great degree is actually not needed if we go to diameters of internal rotating cylinder 6 of say 40 feet or more which is perfectly practical when we normally need so much power and power plants are costing over $300 million apiece, and up to $600 million or more apiece. This latter is possible since for the first time we have a Stirling cycle storage vessel that can be of very large diameter. All other storage vessels I know have the big problem of thermal expansion of the piston forcing the piston's edges against the outer cylinder's walls with the certainty of either the piston sticking against the outer storage cylinder or allowing gas leakage.

In the disclosed invention it is always necessary to have the working gas with a lower molecular weight than that of water. This means that the working gas must largely consist of hydrogen or helium or both mixed together. Hydrogen is the gas normally preferred. A convenient way to prepare that is to thermally crack ammonia which is very conveniently available at a cost that can be easily afforded. The resulting mixture of 75% hydrogen plus the rest as nitrogen makes a very convenient mixture if the compressed gas is used for making liquid nitrogen refrigeration such as will have an enormous market for freezing prepared food dishes if the liquid nitrogen refrigeration was available at a reasonable price. The compressed gas would be cooled by regenerative heat exchange with the gases finally being warmed and by conventional means the compressed gases would be expnaded as is done in the Stirling Cycle used for producing refrigeration. If desired a rotating cylinder separated into warm and very cold sections by a movable piston could be used with its edge in a liquid nitrogen seal (like the water is shown in the invention here).

As regards to the rate of rotation of internal rotating cylinder 6 I usually prefer to use a rate of rotation that will give centrifugal forces on the water seal of the order of a least 100.

In a closed cycle system where make up gas is needed make up gas can be added by valved pipe line 74.

It is very surprizing that a Stirling Cycle Engine with hydrogen or helium under pressure as the working gas can be supplied with heat by regenerative means. This happens for the first time since for the first time we can use a hot gas storage system of appreciable size, providing much more product per stroke of the piston. This allows equipment of very much greater volume to be added to the Stirling Cycle since it is only this extra volume of product that permits, without too much inefficiency added to the engine, part of the product to be used to build up the pressure in this extra volume each stroke of the piston.

Of course if desired this system can be used with the conventional indirect heat exchanger for supplying the heat to the gas instead of regenerator 111.

The use of hydrogen or hydrogen mixed in helium allows molybdenum sheet metal to be used in the hot sections. This allows an increase of the top temperature in the engine to be raised at least 400° Fahrenheit. Since the efficiency theoretically obtainable increases with the top temperature the heat is added and you also are allowed a greater compression ratio by the Stirling Cycle this also greatly increases the efficiency and the amount of power generated by a Stirling Cycle engine of a given type.

Since we are operating under conditions molybdenum will not corrode at high temperatures we have eliminated the usual reason molybdenum is not used at extremely high temperatures to strengthen steel. Therefore the metal screening used in 101 can be made of iron screening with volatile molybdenum compounds heat soaked and be reduced into the iron screening. The iron will always be in a reducing atmosphere so the overall cost of screening will be relatively low.

The use of relatively high pressures are not necessary but they reduce the overall cost of the equipment that is already cheap and to some extent lower even further the heat required per kilowatt of power. Therefore I prefer to use maximum pressures of the order of at least 10 atmospheres when using hydrogen as the working gas.

It is to be emphasized that, while the use of Solar heat is preferable as a supply of heat for the Stirling Cylce engine disclosed, coal may be used if the melting point of the ash is high enough so it does not greatly stick in and accumulate in regenerator 111. It is emphasized that dropping the top temperature normally used does not hurt the efficiency too much especially if cold cooling water is available. It is expected that many coals will require periodic acid washing of various high temperature parts since it is known that scales requiring acid wash removal can form high temperatures on surfaces subjected to high temperature coal combustion gases. However it should be emphasized that there is none of the problems that have prevented the use of coal for gas turbines where very high speed metal surfaces are eroded by ashes and where ashes stick on the blades and cause extreme troubles with high speed air flow that must be very efficient. Also molybdenum and molybdenum alloys, such as molybdenum impregnated iron screen wire will have, are corroded very slowly with hydrochloric acid solutions that are normally used to remove such coal ash formed scales.

In this patent the phrase the "same axis of rotation and the same angular velocity" is defined to mean that the gas taken as a body rotates around the same center line or axis, as the cylinder referred to rotates around the same center line or axis, as the cylinder referred to rotates with the same number of complete rotations per unit time for both referred to.

In this patent the "longitudinal axis of a cylinder" is the straight line joining the centers of the two ends of the cylinder.

EXAMPLES

The preferred way to design any engine from the conversion of heat to power obviously depends on what you assume the cost of the heat to be. In our first case we will accept as true the probably almost universal assumption that the cost of heat will steadily go up in the future. After inventing and filling the patent called a THOUSAND FOOT DIAMETER FOCUSING MIRROR for solar energy in which there is combined a system which puts out artificial light at night and the increase of the corn raised more than pays for the mirror, I in no way believe the cost of heat will go up but in fact will go down. But I will make the assumption like others that the cost of heat will steadily go up as we run out of gas, oil, cheap coal, uranium, etc.

In the above case of expected higher heat costs it would be preferable to build the disclosed improved Stirling Cycle engine as large in diameter as practical. With the custom of building very large central power plants this would be done. For instance by using frame work around the Stirling Cycle engine to allow a flat cylinder under pressure to be built we could go as wide as 200 feet in diameter and easily 100 feet in diameter. In some cases a narrow vertical slit could be made in a rocky mountain side to allow the Stirling Cycle engine to be installed sideways with the rock walls withstanding the longitudinal axial pressure inside the cylinder. (The vertical walls of rock would be rock bolted after coal mining practice to prevent pieces of rock breaking off.) This would produce an extremely low cost Stirling Cycle engine of very high efficiency.

As a result of the immediately proceeding we find we can have very poor overall design and everthing practically I have claimed only be partially true and still have an unbelievably high conversion of heat to power. Say if we use a 10 foot stroke of the piston and a velocity of 3 feet per second for the piston we will obtain in a 10 atmosphere to 20 atmosphere cycle a power rate of over 30 kilowatts per square foot of the area of the piston. Therefore if we assume the worst case possible with the highest theoretically possible radiation heat pick up by the water seal and the high heat pick up of the movement of the mostly hydrogen gases over the water seal to be that of heat pick up with no allowance for the reduction that will occur because of the effect of the centrifugal force on the steam in the gases near the surface of the water, and remember that hydrogen with its very low density and very high thermal conductivity is when under high pressures extremely easy to heat by regenerator 111, we find that we will only have heat losses over that of the theoretical conversion of heat to power of under 700 BTU per kilowatt hour after the power produced is used to make electricity. Assuming an overall additional loss of 15% for the expansion of the compressed hydrogen through a turbine driving an electric generator and knowing we are putting in the heat used at over 2000° Fahrenheit we get a fantastically high conversion of heat to work in relatively low cost equipment. For example this predicts heat rates of the order of 6000 BTU per kilowatt hour of electricity produced which is only half the heat consumptions of many gas turbine power plants of comparable first cost that are widely used.

It is obvious that an enormous step forward has been accomplished in the art of converting heat to power even if the disclosed invention is carried out in the most sloppy manner. For instance the suggestion that the hot gas be introduced into the rotating cylinder 6 should be carried out in a manner so it intially has substantially the same rotation as the cylinder 6 allows the word substantially to be very widely interpreted and still superior results obtained as long as very wide diameter cylinders are used.

However I believe that the described Stirling Cycle engines will normally be built in relatively small units, say of 30 feet in diameter, for the reason the present very high cost of transmitting electricity will be much lower if one builds many small power plants, each near the customers it supplies. Also we will, according to me, see no increase in the cost of heat. Therefore you can see why the invention was written up as if you were building smaller units that have the very frequent problems of extra costs per kilowatt due to small size.

In these cases also we will have the 10 foot stroke and the 3 feet per second travel of the piston, but heat losses will be 1000 to 2,000 BTU more per kilowatt hour, especially if coal is used as the fuel. But in all cases the cost of the electricity to the consumer will be substantially reduced and in many cases this may be as much as by 40%. Of course for special uses like the production of liquid nitrogen level refrigeration for quick freezing of prepared servings of food for a restaurant the cost will drop over two-thirds.

I claim:

1. A process for compressing a gas with a lower molecular weight than water by means of Stirling Cycle which comprises: storing a hot gas and a cold gas of the same composition but in separate compartments with both under approximately the same pressure in a cylinder with the cold and hot gases being separated by a moveable piston, removing cold gas from the cylinder and heating it and introducing the heated cold gas into the end of the cylinder with the hot gas, thus moving the piston and thus increasing the pressure of the hot and cold gas stored, removing gas at increased pressure from the system as a product, reversing the above process with hot gas being removed from the hot gas storage in the cylinder and cooling it and introducing it into the end of the cylinder with the cold gas, thus moving the piston in the opposite direction to that previously obtained and thus decreasing the pressure of the cold and hot gas stored, and introducing gas to be compressed into the system, the novelty comprising revolving the cylinder that stores the hot and cold gases around its longitudinal axis, maintaining a layer of water around the inner surface of the revolving cylinder by centrifugal force, using this layer of water to act as a seal for the edge of the piston as it moves back and forth, and using as the gas mentioned a gas whose density is less than that of pure steam at the same temperature and pressure.

2. A process according to claim 1 in which the gas mentioned as being heated and introduced into the end of the revolving cylinder with the hot gas is introduced into the hot end of the cylinder substantially evenly spread over the cross section of the cylinder with substantially the same angular velocity as the cylinder so the hot gas introduced into the cylinder rotates substantially as a body with the cylinder.

3. A process according to claim 1 in which the gas mentioned as being heated and introduced into the end of the revolving cylinder with the hot gas, is introduced into the hot end of the cylinder evenly spread over the cross section of the cylinder with the same angular velocity as the cylinder so the hot gas introduced into the cylinder rotates as a body with the cylinder.

4. A process according to claim 1 in which the gas compressed contains over 30% by volume hydrogen.

5. A process according to claim 1 in which the gas compressed contains over 80% by volume hydrogen.

6. A process according to claim 1 in which the gas is ammonia which has been decomposed to hydrogen and nitrogen.

7. A process according to claim 2 in which the gas compressed contains over 30% by volume hydrogen.

8. A process according to claim 2 in which the gas compressed contains over 80% by volume hydrogen.

9. A process according to claim 2 in which the gas compressed is ammonia which has been decomposed to hydrogen and nitrogen.

10. A process according to claim 4 in which the ratio of hydrogen to water vapor is maintained at a high enough ratio through out the part of the revolving cylinder storing the hot gas so that at least one part of the hot part of the cylinder molybdenum can not be converted to an oxide by the water vapor present.

11. A process according to claim 7 in which the ratio of hydrogen to water vapor is maintained at a high enough ratio through out the part of the revolving cylinder storing the hot gas so that at least one part of the hot cylinder molybdenum cannot be converted to an oxide by the water vapor present.

* * * * *